US010197022B2

(12) United States Patent
Tucker et al.

(10) Patent No.: US 10,197,022 B2
(45) Date of Patent: Feb. 5, 2019

(54) ADJUSTABLE SOUND DISTRIBUTION SYSTEM AND A VEHICLE

(71) Applicant: GM GLOBAL TECHNOLOGY OPERATIONS LLC, Detroit, MI (US)

(72) Inventors: Eric R. Tucker, Waterford, MI (US); John P. Person, Milford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 82 days.

(21) Appl. No.: 15/378,201

(22) Filed: Dec. 14, 2016

(65) Prior Publication Data

US 2018/0163676 A1 Jun. 14, 2018

(51) Int. Cl.
*F02M 35/12* (2006.01)
*G10K 11/04* (2006.01)
*G10K 11/22* (2006.01)

(52) U.S. Cl.
CPC ..... *F02M 35/125* (2013.01); *G10K 11/04* (2013.01); *G10K 11/22* (2013.01)

(58) Field of Classification Search
CPC ..... F02M 35/1294
USPC ..... 181/204, 229; 123/184.53, 184.57
See application file for complete search history.

(56) References Cited

U.S. PATENT DOCUMENTS 6,600,408 B1 * 7/2003 Walter ..... B60Q 5/00 123/184.21
6,848,410 B2 * 2/2005 Hoffmann ..... G10K 11/22 123/184.57
7,353,791 B2 * 4/2008 Sasaki ..... F02M 35/10019 123/184.53
7,448,353 B2 * 11/2008 Shinada ..... F02M 35/04 123/184.53
7,506,626 B2 * 3/2009 Sasaki ..... F02M 35/1294 123/184.53
7,621,370 B2 * 11/2009 Abe ..... F02M 35/10137 123/184.57
RE42,490 E * 6/2011 Takeuchi ..... F02M 35/10295 123/184.53
7,975,802 B2 * 7/2011 Yokoya ..... F02M 35/10295 123/184.57
8,011,469 B2 * 9/2011 Olson ..... F02M 35/1294 123/184.53
8,127,888 B1 * 3/2012 Mah ..... F02M 35/1216 123/184.53
8,322,486 B2 * 12/2012 Ohta ..... F02M 35/1294 123/184.57
2005/0121255 A1 * 6/2005 Hofmann ..... G10K 11/22 181/250

(Continued)

FOREIGN PATENT DOCUMENTS

DE 102008009534 A1 * 8/2009 ..... G10K 11/22

*Primary Examiner* — Jeremy A Luks
(74) *Attorney, Agent, or Firm* — Quinn IP Law

(57) ABSTRACT

A vehicle and an adjustable sound distribution system that includes an engine operable to produce a pulsation and a sound assembly coupled to the engine. The sound assembly is disposed upstream from the engine. The sound assembly is configured to generate sound from the pulsation. The sound assembly includes a housing defining a cavity configured to resonate the sound that exits the sound assembly. The sound assembly also includes a first member movable to change a frequency of the sound that exits the sound assembly.

20 Claims, 4 Drawing Sheets

(56) References Cited

U.S. PATENT DOCUMENTS

| | | | | |
|---|---|---|---|---|
| 2005/0133300 | A1* | 6/2005 | Hofmann | G10K 11/22 181/250 |
| 2007/0044747 | A1* | 3/2007 | Sawatari | G10K 11/22 123/184.21 |
| 2010/0314193 | A1* | 12/2010 | Jasnie | G10K 11/22 181/175 |
| 2010/0329476 | A1 | 12/2010 | Khami et al. | |
| 2011/0249829 | A1 | 10/2011 | Mah | |
| 2014/0165950 | A1* | 6/2014 | Cho | F02M 35/1222 123/184.57 |

* cited by examiner

ADJUSTABLE SOUND DISTRIBUTION SYSTEM AND A VEHICLE

INTRODUCTION

Vehicles have been designed to minimize sounds entering the passenger compartment. In some vehicles, it is desirable to provide engine operating sounds to the passenger compartment to provide the occupants of the vehicle desirable sound feedback. These vehicles have been designed to direct one frequency of sound to the passenger compartment from the engine. Other vehicles have been designed with foam in a tube to control the volume of sound directed to the passenger compartment.

SUMMARY

The present disclosure provides an adjustable sound distribution system that includes an engine operable to produce a pulsation, and a sound assembly coupled to the engine. The sound assembly is disposed upstream from the engine. The sound assembly is configured to generate sound from the pulsation. The sound assembly includes a housing defining a cavity configured to resonate the sound that exits the sound assembly. The sound assembly also includes a first member movable to change a frequency of the sound that exits the sound assembly.

The present disclosure also provides a vehicle including a passenger compartment and an engine operable to produce a pulsation. The vehicle also includes an air intake apparatus in fluid communication with the engine. The vehicle further includes a sound assembly disposed downstream from the air intake apparatus and upstream from the engine. The sound assembly is configured to generate sound from the pulsation which is directed into the passenger compartment. The sound assembly includes a housing defining a cavity configured to resonate the sound that exits the sound assembly. The sound assembly also includes a first member movable to change a frequency of the sound that exits the sound assembly. Furthermore, the sound assembly includes a first tube coupled between the air intake apparatus and the engine. The first tube is configured to guide the pulsation from the engine into the sound assembly. The sound assembly also includes a second tube extending toward the passenger compartment and configured to guide the sound generated by the sound assembly into the passenger compartment. The first member is movable relative to at least one of the first and second tubes.

The detailed description and the drawings or FIGS. are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims. The phrase "at least one of" as used herein should be construed to include the non-exclusive logical "or", i.e., A and/or B and so on depending on the number of components.

Figure 1:
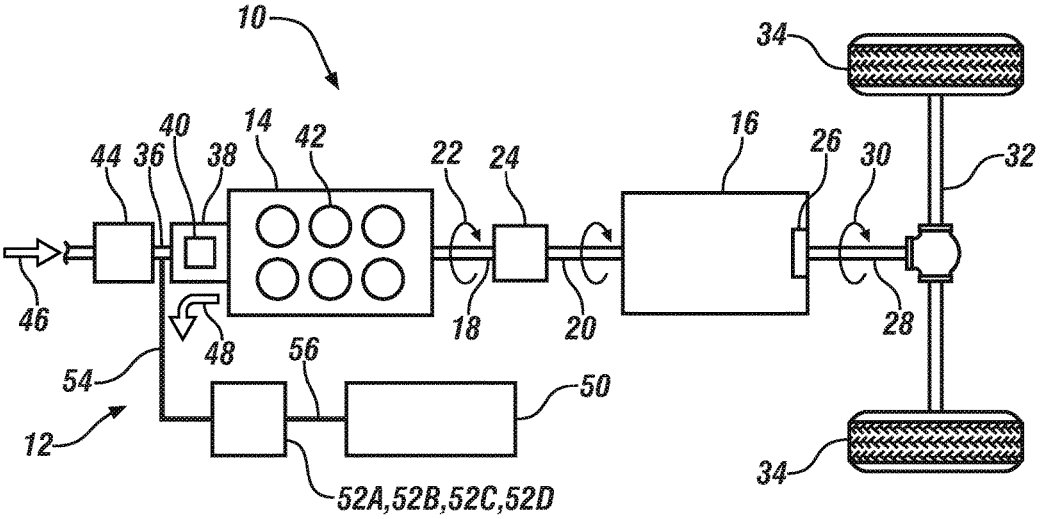
FIG. 1 is a schematic illustration of a vehicle and an adjustable sound distribution system.

Referring to the Figures, wherein like numerals indicate like or corresponding parts throughout the several views, a vehicle 10 and an adjustable sound distribution system 12 are generally shown in FIG. 1.

The adjustable sound distribution system 12 can be utilized in a vehicle application or a non-vehicle application. Non-limiting examples of the vehicles 10 can include cars, trucks, motorcycles, boats, watercrafts, all-terrain vehicles, off-road vehicles, aircrafts, farm equipment or any other suitable movable platform. Non-limiting examples of the non-vehicles can include machines, farm equipment or any other suitable non-vehicle.

The vehicle 10 can include a propulsion system to move the vehicle 10. For example, as shown in FIG. 1, the propulsion system can include an engine 14 and a transmission 16 coupled to the engine 14. Generally, the transmission 16 is coupled to the engine 14 to receive torque outputted from the engine 14. Non-limiting examples of the engine 14 can include an internal combustion engine, hybrid-electric powertrain, an electric motor/generator in addition to the internal combustion engine, or any other suitable type of engine.

Continuing with FIG. 1, the engine 14 can include an output shaft 18, and the transmission 16 can include an input member 20. The output shaft 18 of the engine 14 rotates at an engine speed 22 (see arrow 22), and torque from rotation of the output shaft 18 is transferred to the input member 20 of the transmission 16, which causes the input member 20 to rotate.

Referring to FIG. 1, the vehicle 10 can include a torque converter assembly 24 which is operable between the output shaft 18 and the input member 20. For example, the torque converter assembly 24 can be connected to the output shaft 18 of the engine 14 and the input member 20 of the transmission 16. As such, the output shaft 18 of the engine 14 is rotatable to transfer torque in a direction to the input member 20 of the transmission 16 through the torque converter assembly 24. The torque converter assembly 24 can provide the desired multiplication of torque from the engine 14 into the transmission 16 at low speeds.

Again continuing with FIG. 1, the transmission 16 can include a final drive 26 and an output member 28 that delivers output torque 30 (see arrow 30) to one or more drive axles 32 through the final drive 26, and ultimately to a set of wheels 34. Therefore, torque from the engine 14 is transferred to the transmission 16 and the transmission 16 outputs torque to drive the wheels 34. It is to be appreciated that the final drive 26 can be driven by an endless rotatable member, and non-limiting examples of the endless rotatable member can include a belt or a chain.

The vehicle 10 can also include a duct 36 (see FIG. 1) coupled to the engine 14. The duct 36 can direct or guide a gaseous fluid into the engine 14. For example, the gaseous fluid can be air, exhaust gas mixture (from an exhaust gas recirculation system) or any other suitable gaseous fluid. The duct 36 can also be referred to as an air supply duct.

Again referring to FIG. 1, the vehicle 10 can further include a throttle body 38. The throttle body 38 can be coupled to the duct 36. The throttle body 38 can include a throttle valve 40 which is adjustable to change an amount of gaseous fluid that flows out of the throttle body 38 and into one or more cylinders 42 of the engine 14. In certain embodiments, the adjustable sound distribution system 12 includes the throttle body 38.

The vehicle 10 can also include an air intake apparatus 44 (see FIG. 1) coupled to the duct 36. Generally, the air intake apparatus 44 is in fluid communication with the engine 14. The air intake apparatus 44 can be disposed upstream from the throttle body 38 in a direction of flow 46 (see arrow 46) of the gaseous fluid. The air intake apparatus 44 can deliver, for example, fresh/oxygenated air to one or more of the cylinders 42 of the engine 14. Generally, the air intake apparatus 44 and the throttle body 38 can be coupled together through the duct 36. Therefore, fresh/oxygenated air can be delivered from the air intake apparatus 44 and to the engine 14 through the duct 36. In certain embodiments, the adjustable sound distribution system 12 includes the air intake apparatus 44.

Referring to FIG. 1, the vehicle 10 can include a passenger compartment 50. Generally, one or more occupants can be disposed in the passenger compartment 50. Furthermore, one of the occupants can steer the vehicle 10 from the passenger compartment 50. Sound can be transferred to the passenger compartment 50 through the adjustable sound distribution system 12 as discussed further below.

Generally, the adjustable sound distribution system 12 is coupled to the passenger compartment 50 to provide sound from the engine 14 to the passenger compartment 50. Said differently, operation of the engine 14 produces a pulsation, such as a pressure pulsation, due to the stroke of the cylinders 42, and these pressure pulsations are at frequencies that can be audible. The adjustable sound distribution system 12 can also be coupled to other locations of the vehicle 10 to provide sound from the engine 14 to the outside of the vehicle 10. The adjustable sound distribution system 12 can be manually or automatically adjusted to change the sound that is delivered to the passenger compartment 50 or outside of the vehicle 10, as will be discussed further below.

Continuing with FIG. 1, the adjustable sound distribution system 12 includes a sound assembly 52A, 52B, 52C, 52D coupled to the engine and/or the air intake apparatus 44. The sound assembly 52A, 52B, 52C, 52D is configured to generate sound from the pulsation and direct the sound into the passenger compartment 50. As such, pulsations from operation of the engine 14 are directed to the sound assembly 52A, 52B, 52C, 52D (in the direction of arrow 48), which the sound assembly 52A, 52B, 52C, 52D utilizes to generate the acoustics to be delivered to the passenger compartment 50 to provide the occupants, for example, with a desirable audible indication of the operation of the engine 14. In certain embodiments, the sound assembly 52A, 52B, 52C, 52D is also coupled to the throttle body 38. Generally, the sound assembly 52A, 52B, 52C, 52D is disposed downstream from the air intake apparatus 44 and upstream from the engine 14. More specifically, the sound assembly 52A, 52B, 52C, 52D is disposed downstream from the air intake apparatus 44 relative to the direction of flow 46 of the gaseous fluid and upstream from the engine 14 relative to the direction of flow 46 of the gaseous fluid. In certain embodiments, the entry to the sound assembly 52A, 52B, 52C, 52D is disposed between the air intake apparatus 44 and the throttle body 38. For example, the entry to the sound assembly 52A, 52B, 52C, 52D can be along the portion of the duct 36 between the air intake apparatus 44 and the throttle body 38.

Pressure pulsation from the operation of the engine 14 can travel from the engine 14 into the duct 36 and then into the sound assembly 52A, 52B, 52C, 52D. Therefore, the operation of the engine 14 can produce the pulsation that can travel in the direction of arrow 48. Specifically, the pulsation can travel out of the engine 14, through the throttle body 38, into the duct 36 and into the sound assembly 52A, 52B, 52C, 52D. Once the pulsation reaches the sound assembly 52A, 52B, 52C, 52D, the sound assembly 52A, 52B, 52C, 52D utilizes the pulsation to generate the desired sound to be delivered to the passenger compartment 50. It is to be appreciated that the pulsation can also travel into the air intake apparatus 44.

Continuing with FIG. 1, the sound assembly 52A, 52B, 52C, 52D can include a first tube 54 coupled to the engine 14 and/or coupled to the air intake apparatus 44. In certain embodiments, the first tube 54 is coupled between the air intake apparatus 44 and the engine 14. The first tube 54 is configured to guide the pulsation from the engine 14 into the sound assembly 52A, 52B, 52C, 52D. Generally, the first tube 54 is attached (directly or indirectly) to the duct 36 to deliver or guide the pulsation to the sound assembly 52. It is to be appreciated that some of the gaseous fluid can enter the first tube 54 from the air intake apparatus 44 due to fluid communication with the duct 36, but the gaseous fluid is blocked by various components of the sound assembly 52A, 52B, 52C, 52D from entering the passenger compartment 50 as discussed further below.

Additionally, the sound assembly 52A, 52B, 52C, 52D can include a second tube 56 extending toward the passenger compartment 50. The second tube 56 is directed to the passenger compartment 50 to deliver or guide the desired acoustics or sound generated by the sound assembly 52A, 52B, 52C, 52D into the passenger compartment 50. Therefore, the second tube 56 guides the sound away from the sound assembly 52A, 52B, 52C, 52D. The first and second tubes 54, 56 are separated from each other by various components of the sound assembly 52A, 52B, 52C, 52D as discussed below. It is to be appreciated that the second tube 56 can branch to another location to deliver the acoustics or sound from the sound assembly 52A, 52B, 52C, 52D to the outside of the vehicle 10.

The sound assembly 52A, 52B, 52C, 52D can be many different configurations, some of which are described herein.

For each of the configurations, generally, the first tube 54 directs or guides the pulsation to the sound assembly 52A, 52B, 52C, 52D and the second tube 56 directs or guides the acoustics or sound from the sound assembly 52A, 52B, 52C, 52D into the passenger compartment 50. Therefore, the above discussion applies to all of the embodiments of the sound assembly 52A, 52B, 52C, 52D, and FIG. 1 applies generally to all of the embodiments.

Each of the embodiments of the sound assembly 52A, 52B, 52C, 52D includes a housing 58 defining a cavity 60 configured to resonate the sound that exits the sound assembly 52A, 52B, 52C, 52D. The second tube 56 is configured to guide the sound from the cavity 60 out of the sound assembly 52A, 52B, 52C, 52D, and ultimately into the passenger compartment 50. The sound is guided to the passenger compartment 50 without passing the gaseous fluid from the air intake apparatus 44 out of the second tube 56. Therefore, the sound assembly 52A, 52B, 52C, 52D prevents the gaseous fluid (from the air intake apparatus 44) from being expelled outside of the sound assembly 52A, 52B, 52C, 52D, i.e., prevents leaks of the gaseous fluid, which assists in ensuring the desired flow of fresh/oxygenated air is delivered to the cylinders 42 of the engine 14.

Figure 2:
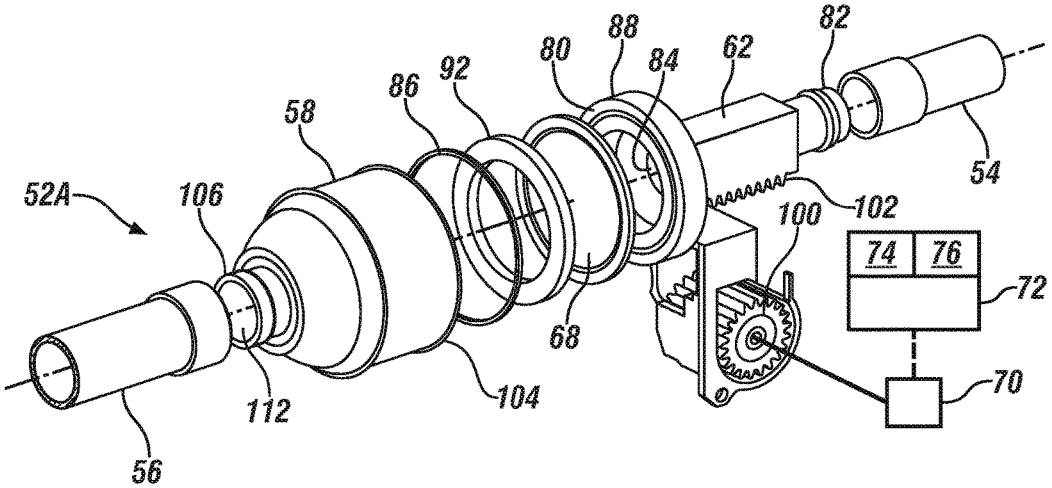
FIG. 2 is a schematic exploded view of a sound assembly of a first configuration.
Figure 3:
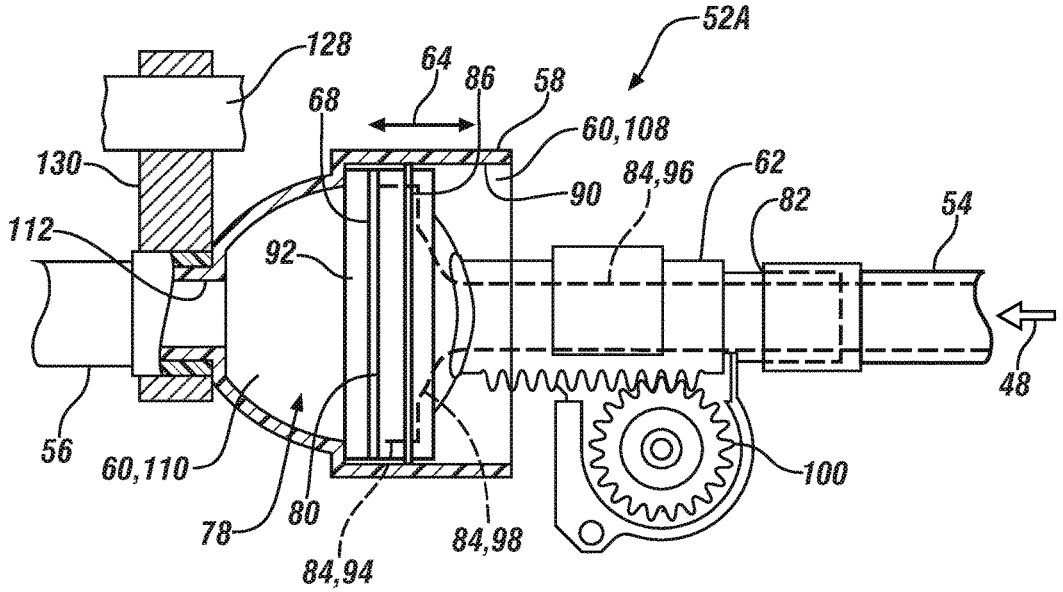
FIG. 3 is a schematic partial cross-sectional view of the sound assembly of FIG. 2, with a first member in a first position.
Figure 4:
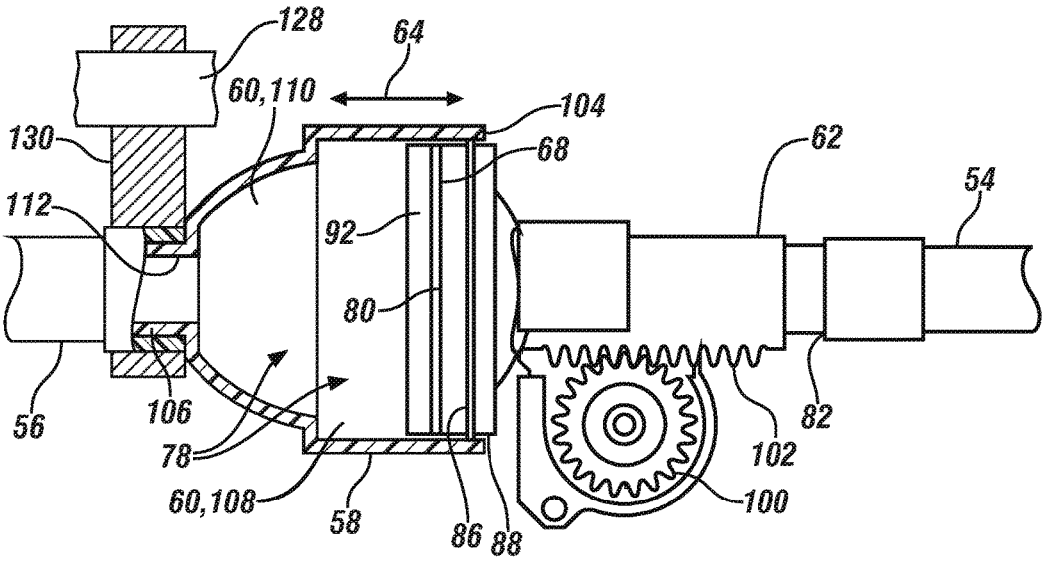
FIG. 4 is a schematic partial cross-sectional view of the sound assembly of FIGS. 2 and 3, with the first member in a second position.
Figure 5:
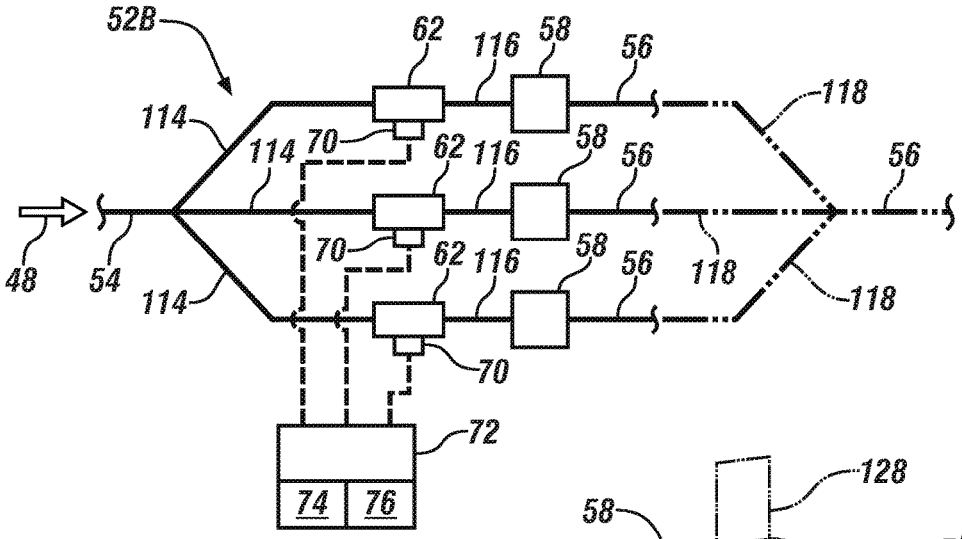
FIG. 5 is a schematic illustration of a second configuration of the sound assembly.
Figure 8:
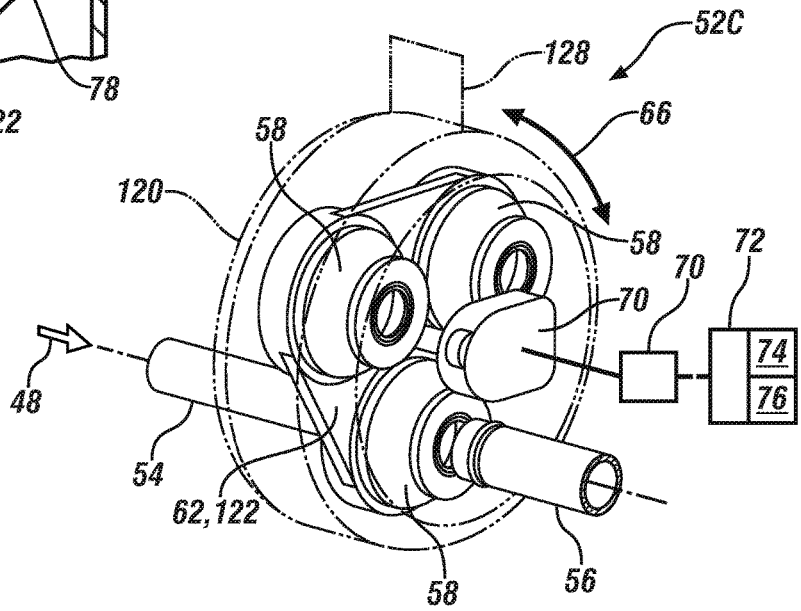
FIG. 8 is a schematic perspective view of a third configuration of the sound assembly.

For each of the embodiments of the sound assembly 52A, 52B, 52C, 52D, the sound assembly 52A, 52B, 52C, 52D includes a first member 62 movable to change a frequency of the sound that exits the sound assembly 52A, 52B, 52C, 52D. In certain embodiments, the first member 62 is movable relative to at least one of the first and second tubes 54, 56. In the embodiment of FIGS. 2-4, the first member 62 is movable relative to the second tube 56. In the embodiments of FIGS. 2-4 and 9, the first member 62 is movable linearly (see arrow 64). In the embodiment of FIG. 8, the first member 62 is rotatable (see arrow 66). In the embodiment of FIG. 5, the first member 62 can be rotatable or movable linearly.

Again, for each of the embodiments of the sound assembly 52A, 52B, 52C, 52D, the sound assembly 52A, 52B, 52C, 52D can include a diaphragm 68 disposed inside the cavity 60 that blocks the gaseous fluid disposed in the first tube 54 from entering the second tube 56. The diaphragm 68 blocks the flow of gaseous fluid (from the air intake apparatus 44) toward the passenger compartment 50. The pulsation from the engine 14 interacts with the diaphragm 68 such that the diaphragm 68 generates the sound that exits the cavity 60 through the second tube 56. The pulsation engages the diaphragm 68 which causes the diaphragm 68 to vibrate, which creates sound that resonates in the cavity 60 and exits the cavity 60 toward the passenger compartment 50. The diaphragm 68 can be formed of any suitable materials, suitable thicknesses, suitable tension, etc. to provide the characteristics that assist in producing the desired frequency of sound.

For each of the embodiments of the sound assembly 52A, 52B, 52C, 52D, the sound assembly 52A, 52B, 52C, 52D can include an actuator 70 coupled to the first member 62 to selectively move the first member 62 to one of a plurality of positions to select the desired frequency of the sound that exits the sound assembly 52A, 52B, 52C, 52D through the cavity 60. In certain embodiments, actuation of the actuator 70 can cause linear movement of the first member 62. In other embodiments, actuation of the actuator 70 can cause rotational movement of the first member 62. In yet other embodiments, actuation of the actuator 70 can cause rotational or linear movement of the first member 62.

For all of the embodiments of the sound assembly 52A, 52B, 52C, 52D, a controller 72 can be utilized to set the sound assembly 52A, 52B, 52C, 52D to the desired frequency of the sound. Specifically, the controller 72 can be in electrical communication with the actuator 70. Therefore, the controller 72 can operate the actuator 70 to control the frequency of the sound that is directed to the passenger compartment 50. Instructions can be stored in a memory 74 of the controller 72 and automatically executed via a processor 76 of the controller 72 to provide the respective control functionality.

The controller 72 is configured to execute the instructions from the memory 74, via the processor 76. For example, the controller 72 can be a host machine or distributed system, e.g., a computer such as a digital computer or microcomputer, and, as the memory 74, tangible, non-transitory computer-readable memory such as read-only memory (ROM) or flash memory. The controller 72 can also have random access memory (RAM), electrically erasable programmable read-only memory (EEPROM), a high-speed clock, analog-to-digital (A/D) and/or digital-to-analog (D/A) circuitry, and any required input/output circuitry and associated devices, as well as any required signal conditioning and/or signal buffering circuitry. Therefore, the controller 72 can include all software, hardware, memory 74, algorithms, connections, sensors, etc., necessary to control, for example, the actuator 70. As such, a control method operative to control the actuator 70, can be embodied as software or firmware associated with the controller 72. It is to be appreciated that the controller 72 can also include any device capable of analyzing data from various sensors, comparing data, making the necessary decisions required to control and/or monitor the actuator 70. Optionally, more than one controller 72 can be utilized, and the controller(s) 72 can be in communication with other components.

One of the frequencies can be pre-set during the manufacturing process. To change the frequency, the manufacturer and/or the occupant of the vehicle 10 can make the change. For example, the occupant can select a button, a switch, a touch screen, a mobile device application, a key fob, etc. to change the frequency. The button, switch, etc., can be in electrical communication with the controller 72 which controls the actuator 70 accordingly to select the desired frequency of the sound that is to be directed to the passenger compartment 50.

In certain embodiments, the first member 62 can be at least partially disposed in the cavity 60 which creates an open space 78 inside the housing 58. Comparing FIGS. 3 and 4, the first member 62 can be movable relative to the housing 58 to change a size of the open space 78 inside the cavity 60 which changes the frequency of the sound that exits the cavity 60. Therefore, a volume of the open space 78 can be changed inside the housing 58. In this embodiment, the diaphragm 68 is attached (directly or indirectly) to the first member 62 and is contained inside the cavity 60. Movement of the first member 62 can change a position of the diaphragm 68 inside the cavity 60 which changes the size of the open space 78 inside the cavity 60. In this embodiment, the first member 62 can be further defined as a plunger or piston. Therefore, in this embodiment, the diaphragm 68 is attached to the plunger or piston.

Continuing with the embodiment of FIGS. 2-4, the first member 62 can include a first end 80 and a second end 82 spaced from each other. The diaphragm 68 can be attached to the first end 80 or any other suitable location along the first member 62. The first member 62 can define a hole 84 extending through the first end 80 and the second end 82. The hole 84 guides the pulsation to the diaphragm 68. The diaphragm 68 covers the hole 84 at the first end 80 to block the gaseous fluid from exiting the first member 62 at the first end 80. Optionally, a seal 86 can be utilized to minimize acoustics/sound created by the diaphragm from escaping the cavity 60. The seal 86 can be disposed along an outer periphery 88 of the first member 62. The seal 86 can be sandwiched between the outer periphery 88 and an inner surface 90 of the housing 58. Additionally, the seal 86 can minimize debris or sounds from entering the cavity 60 between the outer periphery 88 and the inner surface 90 of the housing 58. The seal 86 can be any suitable configuration and location. As one non-limiting example, the seal 86 can be an o-ring. Furthermore, optionally, the outer periphery 88 of the first member 62 can define a recess with the seal 86 disposed in the recess and protruding from the recess.

The diaphragm 68 can be secured to the first member 62 by any suitable components and/or methods, which can include one or more of fasteners, clips, snaps, tabs, couplers, press fit, interference fit, friction fit, welding, adhesive, etc. FIG. 2 illustrates, for illustrative purposes only, a ring 92 that sandwiches an outer edge portion of the diaphragm 68 to the first member 62.

The hole 84 of the first member 62 can be any suitable configuration and one non-limiting example is discussed below. Optionally, the hole 84 can include a first hole portion 94 having a first diameter and a second hole portion 96 having a second diameter. Generally, the first diameter is greater than the second diameter. Therefore, the hole 84 of the first member 62 can be configured having different sizes. Furthermore, optionally, the hole 84 can include a third hole portion 98 disposed between the first and second hole portions 94, 96, with the third hole portion 98 optionally tapering, and thus the diameter of the third hole portion 98 can continuously increase or decrease relative to the second end 82 of the first member 62.

Continuing with FIGS. 2-4, the sound assembly 52A includes a second member 100 coupled to the first member 62. The second member 100 is movable to selectively move the first member 62 relative to the housing 58. In this embodiment, the second member 100 can include a gear engaging the first member 62. Furthermore, the first member 62 can include a rack 102, and the rack 102 can include a plurality of teeth in which the gear meshes with the teeth of the rack 102. Rotation of the gear causes linear movement of the rack 102 which moves the first member 62 linearly relative to the housing 58 (compare FIGS. 3 and 4). The actuator 70 is coupled to the second member 100, and therefore, actuation of the actuator 70 moves the second member 100 which correspondingly causes movement of the first member 62. In this embodiment, the actuator 70 causes rotational movement of the second member 100 which causes linear movement of the first member 62. The movement of the first member 62 changes the position of the diaphragm 68 inside the cavity 60 which changes the size of the open space 78 inside the cavity 60, and thus changes the frequency of the sound that enters the passenger compartment 50. Said differently, the volume of the open space 78 changes inside the cavity 60 when the first member 62 moves, and thus changes the frequency of the sound that enters the passenger compartment 50.

Referring to FIGS. 2-4, the housing 58 can include a first end 104 and a second end 106 spaced from each other. The cavity 60 (of the housing 58) can extend through the first end 104 of the housing 58. Furthermore, the cavity 60 can be spaced from the second end 106 of the housing 58. In this embodiment, the first tube 54 can be attached to the second end 82 of the first member 62 and the second tube 56 can be attached (directly or indirectly) to the second end 106 of the housing 58. The first tube 54 is coupled to the engine 14 and/or the air intake apparatus 44 and configured to guide the pulsation from the engine 14 into the first member 62. The second tube 56 is configured to guide the sound from the cavity 60 out of the sound assembly 52A. The diaphragm 68 is disposed inside the cavity 60 to block the gaseous fluid from the first tube 54 from entering the second tube 56. Furthermore, the pulsation from the engine 14 interacts with the diaphragm 68 such that the diaphragm 68 generates the sound that exits the cavity 60 through the second tube 56. Therefore, the diaphragm 68 is disposed between the first and second ends 104, 106 of the housing 58.

The cavity 60 of the housing 58 can be any suitable configuration, and one non-limiting example is discussed below. Optionally, the cavity 60 can include a first cavity portion 108 having a first diameter and a second cavity portion 110 having a second diameter, with the first diameter being greater than the second diameter. In certain embodiments, the second cavity portion 110 can optionally taper, and thus the diameter can continuously increase or decrease relative to the second end 106 of the housing 58. Therefore, the cavity 60 of the housing 58 can be configured having different sizes.

Generally, referring to FIGS. 3 and 4, the first member 62 is disposed in the first cavity portion 108, and therefore, in this embodiment, the diaphragm 68 is disposed in the first cavity portion 108. Furthermore, the first member 62 is movable within the first cavity portion 108, and therefore, in this embodiment, the diaphragm 68 is movable in the first cavity portion 108. In this embodiment, the open space 78 of the cavity 60 can include the second cavity portion 110 and any open space 78 of the first cavity portion 108 that is between the second cavity portion 110 and the first end 80 of the first member 62. Comparing FIGS. 3 and 4, movement of the first member 62 in the first cavity portion 108 changes the size of the open space 78 in the cavity 60. Specifically, there is less open space 78 in FIG. 3 as compared to FIG. 4. Since the first tube 54 is attached to the first member 62, movement of the first member 62 also moves the first tube 54. Therefore, the first tube 54 is designed with extra length to allow movement of the first tube 54 with the first member 62 without causing unwanted pulling at various connections.

The housing 58 can also define an aperture 112 extending through the second end 106 of the housing 58 and adjoins the cavity 60. The aperture 112 is in direct fluid communication with the second tube 56. Therefore, sound created by the diaphragm 68 moves through the second cavity portion 110 into the aperture 112 and out through the second tube 56 toward the passenger compartment 50. The aperture 112 can be any suitable configuration, and as one non-limiting example, as shown in FIGS. 3 and 4, the aperture 112 can have a diameter less than the first cavity portion 108.

Referring to FIG. 5, another configuration of the sound assembly 52B is illustrated. Specifically, in this embodiment, the configuration of the first member 62 is changed. Also, in this embodiment, the housing 58 is defined as a plurality of housings 58 each defining one cavity 60, the diaphragm 68 is defined as a plurality of diaphragms 68 and the first member 62 is defined as a plurality of first members 62. As discussed above, the first member 62 is movable to change the frequency of the sound that exits the sound assembly 52A, 52B, 52C, 52D; and this same concept applies to the plurality of first members 62 of this embodiment.

Figure 6:
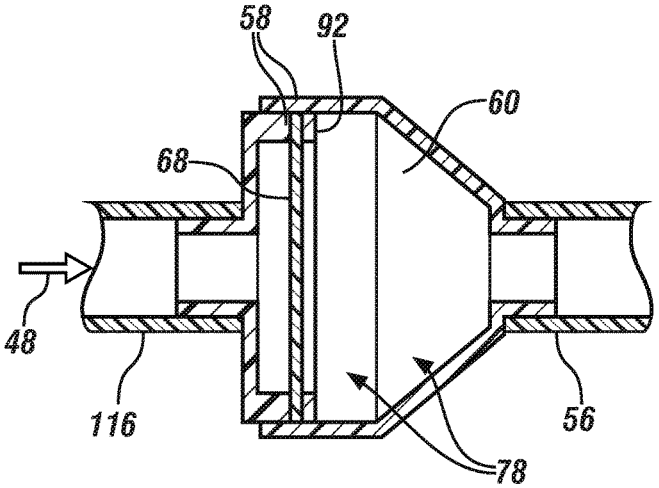
FIG. 6 is a schematic fragmentary cross-sectional view of a housing configuration and a diaphragm configuration that can be utilized in the sound assembly of FIG. 5.

For the embodiment of FIG. 5, one diaphragm 68 is disposed in one cavity 60 of one housing 58, another diaphragm 68 is disposed in another cavity 60 of another housing 58, and so on for the number of housings 58 being utilized. The housings 58 are shown schematically in FIG. 5 for illustrative purposes only. FIG. 6 illustrates one suitable configuration of each of the housings 58 with respective diaphragms 68 that can be utilized in FIG. 5. One of the diaphragms 68 is disposed in the cavity 60 of the respective housings 58 to set different frequencies of the sound that resonates in each cavity 60. In this embodiment, the position of each of the diaphragms 68 is fixed relative to the housing 58. As such, one of the diaphragms 68 is fixed to a respective one of the housings 58 inside a respective one of the cavities 60. Therefore, respective cavities 60 and respective diaphragms 68 cooperate to produce a different frequency of the sound that can be delivered to the passenger compartment 50. Said differently, one frequency of sound is produced in one housing 58, a different frequency of sound is produced in another housing 58, and so on for the number of housings 58 utilized. To produce different frequencies in each of the housings 58, the diaphragms 68 can be in different locations in the respective cavities 60, the diaphragms 68 can be of different materials, different thicknesses, different tensions, etc., and/or the cavities 60 can be of different configurations.

FIG. 5 also illustrates the plurality of first members 62, with one first member 62 cooperating with one housing 58, etc. The first members 62 of FIG. 5 are illustrated schematically for illustrative purposes only. One of the first members 62 cooperates with a respective one of the housings 58. As such, one first member 62 prevents and allows the pulsation to one of the housings 58, another first member 62 prevents and allows the pulsation to another one of the housings 58 and so on for the number of housings 58 being utilized. As illustrated in FIG. 5, three housings 58 and three first members 62 are utilized; therefore, for example, one of the first members 62 can be actuated to allow the pulsation into the respective one of the housings 58 and the other two first members 62 can be actuated to prevent the pulsation into the respective other two housings 58. In the example of actuation immediately above, one single frequency of sound is delivered to the passenger compartment 50 from one of the housings 58 since one of the first members 62 is allowing the pulsation to interact with one of the diaphragms 68 of the respective one of the housings 58.

If a different frequency of sound is desired, then a different first member 62 is actuated to allow the pulsation to interact with another diaphragm 68 through another housing 58 while the other first member 62 is actuated to close fluid communication to the other housing 58 to stop that frequency of the sound to the passenger compartment 50. Therefore, depending on actuation of the first members 62, the pulsation can be delivered to one or more of the housings 58. For example, one of the first members 62 can allow and prevent the pulsation to one of the housings 58, another one of the first members 62 can allow and prevent the pulsation to another one of the housings 58, etc. If two or more of the first members 62 are actuated to allow the pulsation to the respective two housings 58, then the two different frequencies are combined to a different frequency of the sound that is delivered to the passenger compartment 50.

For the embodiment of FIG. 5, the first members 62 can each be defined as a valve movable between an open position which allows fluid communication to the respective housings 58 and a closed position which prevents fluid communication to the respective housings 58. At least one of the valves is in the open position to select the desired frequency of the sound that exits the cavity 60 of the respective housings 58. As one non-limiting example, one of the valves can be in the open position and the other valves all in the closed position. The valves can be any suitable configuration, and non-limiting examples of the type of valves that can be utilize includes ball valves, needle valves, plug valves, butterfly valves, flow limiter valves, mass flow control valves, etc. The valve can be operated by a solenoid, a motor, a switch, etc., and/or can be operated pneumatically, hydraulically, mechanically, electrically, etc., to move between the open and closed positions. Therefore, in this embodiment, the first members 62 are movable relative to at least one of the first and second tubes 54, 56. In one embodiment, the first members 62 can be movable relative to both of the first and second tubes 54, 56.

As shown in FIG. 5, the first tube 54 can split into a plurality of first segments 114, with one first member 62 and one housing 58 disposed along one of the first segments 114, and so on for the number of housings 58 and first members 62 being utilized. Therefore, one valve controls the pulsation to one housing 58 along one of the first segments 114, and so on. As also shown in FIG. 5, the sound assembly 52B can further include a plurality of third tubes 116 disposed between the first tube 54 and the second tube 56. Specifically, one of the third tubes 116 are disposed between respective first members 62 and respective housings 58. The third tubes 116 direct or guide the pulsation to the respective housings 58 if the respective valve is in the open position.

Alternatively, a single first member 62 can be utilized for the embodiment of FIG. 5 and the first segments 114 can be eliminated. Non-limiting examples of the single first member 62 can include a two-way valve, a three-way valve, a four-way valve, etc. Therefore, a single valve can be in fluid communication with the first tube 54 from one location of the valve and the third tubes 116 can be in fluid communication with the valve from other locations of the valve. Therefore, depending on which of the housings 58 is to receive the pulsation, the valve can be controlled to direct or guide the pulsation to the respective housings 58 through the respective third tubes 116.

Additionally, as shown in FIG. 5, the second tube 56 can be in different configurations (one shown in solid lines and another shown in phantom lines). As shown in solid lines in FIG. 5, the second tube 56 can be defined as a plurality of second tubes 56 spaced from each other, and these second tubes 56 each individually extend toward the passenger compartment 50 and do not rejoin into a single tube. Therefore, for example, sound from one of the second tubes 56 is received by the passenger compartment 50.

As shown in phantom lines in FIG. 5, the second tube 56 can include a plurality of second segments 118, with one first member 62 and one housing 58 disposed along one of the second segments 118, and so on for the number of housings 58 and first members 62 being utilized. The second segments 118 can join together into a single portion of the second tube 56 that extends toward the passenger compartment 50. Therefore, sound from any of the second segments 118 will be received by the single portion of the second tube 56, and then the sound from the single portion of the second tube 56 is received by the passenger compartment 50.

Figure 9:
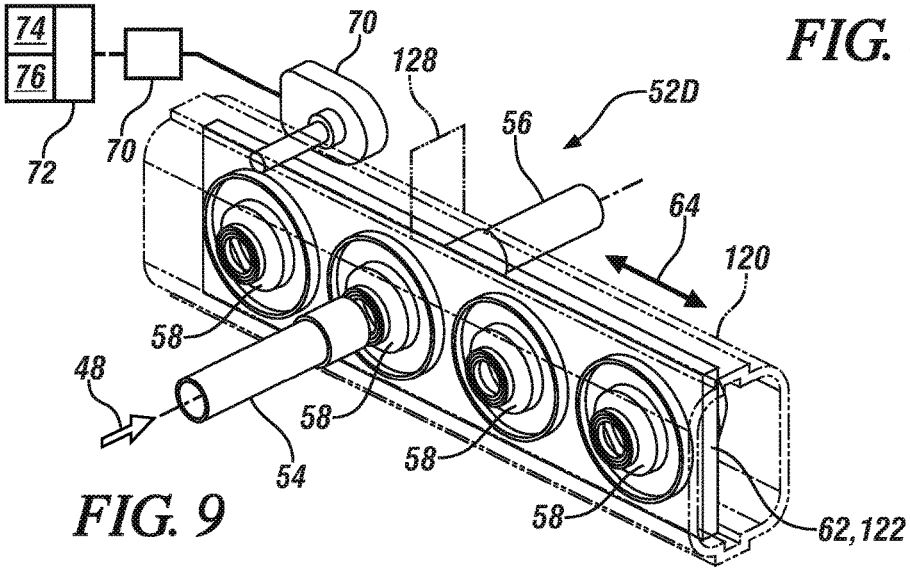
FIG. 9 is a schematic perspective view of a fourth configuration of the sound assembly.

Referring to FIGS. 8 and 9, two other configurations of the first member 62 is illustrated. In these embodiments, the housing 58 is defined as a plurality of housings 58 each defining one cavity 60 and the diaphragm 68 is defined as a plurality of diaphragms 68. In these embodiments, one first member 62 is utilized, and the first member 62 can optionally surround at least part of the plurality of housings 58. As discussed above, the first member 62 is movable to change the frequency of the sound that exits the sound assembly 52A, 52B, 52C, 52D, and this same concept applies to these embodiments.

In these embodiments, the sound assembly 52C, 52D can include a container 120 that surrounds or contains the plurality of housings 58. Optionally, the housings 58 can be completely contained inside the container 120. The container 120 is shown in phantom lines in FIGS. 8 and 9 to illustrate the components inside of the container 120. For the embodiment of FIG. 9, the container 120 can be open at both ends to allow the housings 58 to move back and forth linearly without interference from the container 120, or alternatively the container 120 can be large enough to allow the linear movement while completely containing the housings 58. The first member 62 can be attached (directly or indirectly) to the housings 58. For example, in this embodiment, the first member 62 can be defined as a bracket 122 or a support that is configured to fix the position of the housings 58 relative to each other. Optionally, in certain embodiments, the bracket 122 can be completely contained inside the container 120.

Figure 10:
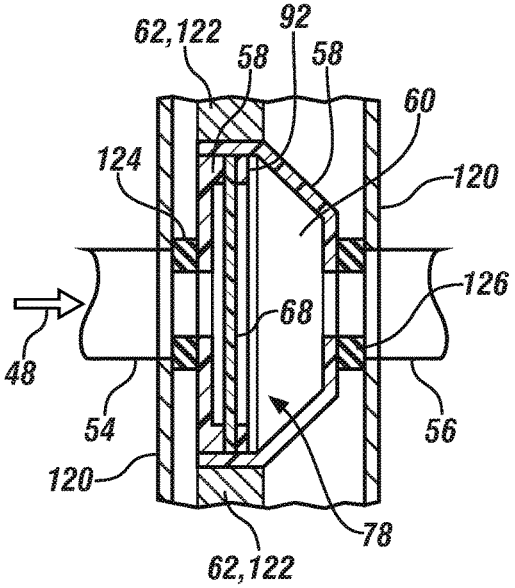
FIG. 10 is schematic fragmentary partial cross-sectional view of a container cooperating with a first tube and a second tube, with a housing configuration and a diaphragm configuration that can be utilized in the sound assembly of FIGS. 8 and 9.

For the embodiments of FIGS. 8 and 9, one diaphragm 68 is disposed in one cavity 60 of one housing 58, another diaphragm 68 is disposed in another cavity 60 of another housing 58, and so on for the number of housings 58 being utilized. FIG. 10 illustrates one suitable configuration of each of the housings 58 and the diaphragms 68 in relation to the first and second tubes 54, 56 that can be utilized in FIGS. 8 and 9. One of the diaphragms 68 is disposed in the cavity 60 of the respective housings 58 to set different frequencies of the sound that resonates in each cavity 60. In these embodiments, the position of each of the diaphragms 68 is fixed relative to the housing 58. As such, one of the diaphragms 68 is fixed to a respective one of the housings 58 inside a respective one of the cavities 60. Therefore, respective cavities 60 and respective diaphragms 68 cooperate to produce a different frequency of the sound that can be delivered to the passenger compartment 50. Said differently, one frequency of the sound is produced in one housing 58, a different frequency of the sound is produced in another housing 58, and so on for the number of housings 58 utilized. To produce different frequencies in each of the housings 58, the diaphragms 68 can be in different locations in the respective cavities 60, the diaphragms 68 can be of different materials, different thicknesses, different tensions, etc., and/or the cavities 60 can be of different configurations, etc.

The first member 62 is movable to select the desired frequency of the sound that exits the cavity 60 of the respective housings 58. Therefore, movement of the first member 62 correspondingly moves the housings 58 to select the desired frequency of the sound that is delivered to the passenger compartment 50. In certain embodiments, the first member 62 is movable relative to at least one of the first and second tubes 54, 56. Specifically, in this embodiment, the first member 62 can be movable relative to the first and second tubes 54, 56. The actuator 70 is coupled to the first member 62, i.e., the bracket 122 for this embodiment, such that actuation of the actuator 70 causes the first member 62, i.e., the bracket 122, to move which changes the housing 58 that aligns with the first and second tubes 54, 56, and thus which frequency of the sound is being delivered to the passenger compartment 50. A first seal 124 can be utilized between the first tube 54 and the housing 58 that is to be resonating the sound to prevent the gaseous fluid and the pulsation from leaking out of the container 120. Furthermore, a second seal 126 can be utilized between the second tube 56 and the housing 58 that is to be resonating the sound to prevent the sound from leaking out of the container 120.

Figure 7:
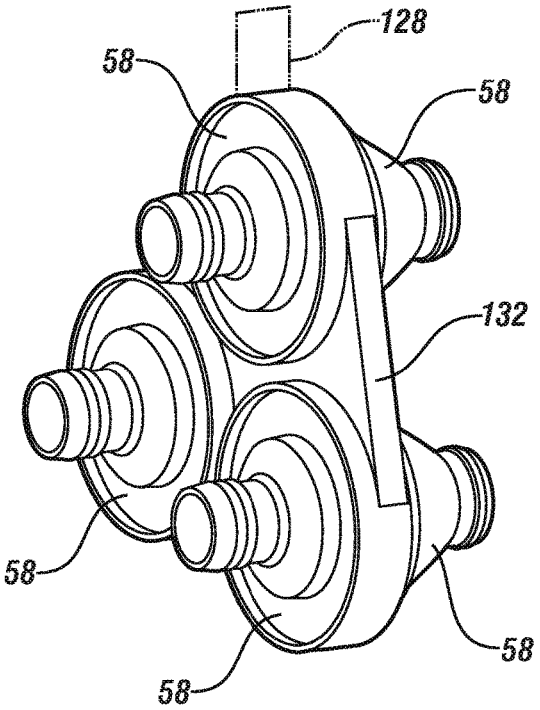
FIG. 7 is a schematic perspective view of a bracket that can couple a plurality of housings together.

It is to be appreciated that the sound assembly 52A, 52B, 52C, 52D can be supported by a fixed component 128 (illustrated in solid lines in FIGS. 3 and 4, and illustrated in phantom lines in FIGS. 7-9). For the embodiment of FIGS. 2-4 the housing 58 can be supported by a bracket 130 that is attached (directly or indirectly) to the fixed component 128. For the embodiment of FIG. 5, the housings 58 can be grouped together and supported by a bracket 132 as illustrated in FIG. 7. The bracket 132 of FIG. 7 can be attached (directly or indirectly) to the fixed component 128. Alternatively, for the embodiment of FIG. 5, the housings 58 can be individually supported by the fixed component 128 instead of utilizing the bracket 132. For the embodiments of FIGS. 8 and 9, the container 120 can be attached (directly or indirectly) to the fixed component 128.

While the best modes and other embodiments for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. An adjustable sound distribution system comprising:

an engine operable to produce a pulsation; and a sound assembly coupled to the engine and disposed upstream from the engine, and wherein the sound assembly is configured to generate sound from the pulsation; the sound assembly comprising:

a housing defining a cavity configured to resonate the sound that exits the sound assembly;

a first member movable to change a frequency of the sound that exits the sound assembly;

wherein the first member is at least partially disposed in the cavity which creates an open space inside the housing, and wherein the first member is movable relative to the housing to change a size of the open space inside the cavity which changes the frequency of the sound that exits the cavity; and wherein the sound assembly includes a diaphragm attached to the first member and contained inside the cavity, and wherein movement of the first member changes a position of the diaphragm inside the cavity which changes the size of the open space inside the cavity.

2. The system as set forth in claim 1 wherein the sound assembly includes a first tube coupled to the engine and configured to guide the pulsation from the engine into the sound assembly and a second tube configured to guide the sound away from the sound assembly, with the first member movable relative to at least one of the first and second tubes.

3. The system as set forth in claim 2 wherein the diaphragm is disposed inside the cavity that blocks a gaseous fluid disposed in the first tube from entering the second tube, and wherein the pulsation interacts with the diaphragm such that the diaphragm generates the sound that exits the cavity through the second tube.

4. The system as set forth in claim 2 wherein the sound assembly includes an actuator coupled to the first member to selectively move the first member to one of a plurality of positions to select the desired frequency of the sound that exits the sound assembly through the cavity.

5. The system as set forth in claim 4 wherein actuation of the actuator causes linear movement of the first member.

6. The system as set forth in claim 1 wherein the first member is further defined as a plunger, with the diaphragm attached to the plunger.

7. The system as set forth in claim 1 wherein the first member includes a first end and a second end spaced from each other, with the diaphragm attached to the first end, and wherein the first member defines a hole extending through the first end and the second end, with the diaphragm covering the hole at the first end to block a gaseous fluid from exiting the first member at the first end.

8. The system as set forth in claim 7 wherein the hole includes a first hole portion having a first diameter and a second hole portion having a second diameter, with the first diameter being greater than the second diameter.

9. The system as set forth in claim 1 wherein the sound assembly includes a second member coupled to the first member, and the second member is movable to selectively move the first member relative to the housing.

10. The system as set forth in claim 9 wherein the second member includes a gear engaging the first member.

11. The system as set forth in claim 10 wherein the first member includes a rack, and the rack includes a plurality of teeth in which the gear meshes with the teeth of the rack, and wherein rotation of the gear causes linear movement of the rack which moves the first member linearly relative to the housing.

12. An adjustable sound distribution system comprising:
an engine operable to produce a pulsation; and
a sound assembly coupled to the engine and disposed upstream from the engine, and wherein the sound assembly is configured to generate sound from the pulsation; the sound assembly comprising:
a housing defining a cavity configured to resonate the sound that exits the sound assembly;
a first member movable to change a frequency of the sound that exits the sound assembly;
a diaphragm;
wherein:
the first member includes a first end and a second end spaced from each other, with the diaphragm attached to the first end;
the housing includes a first end and a second end spaced from each other, with the cavity extending through the first end of the housing, and spaced from the second end of the housing;
the sound assembly includes a first tube attached to the second end of the first member and a second tube attached to the second end of the housing; and
the first tube is coupled to the engine and configured to guide the pulsation from the engine into the first member, and the second tube is configured to guide the sound from the cavity out of the sound assembly.

13. The system as set forth in claim 12 wherein the diaphragm is disposed is inside the cavity and blocks a gaseous fluid from entering the second tube, and wherein the pulsation from the engine interacts with the diaphragm such that the diaphragm generates the sound that exits the cavity through the second tube.

14. The system as set forth in claim 13 wherein:
the cavity includes a first cavity portion having a first diameter and a second cavity portion having a second diameter, with the first diameter being greater than the second diameter;
the housing defines an aperture extending through the second end of the housing and adjoins the cavity, with the aperture in direct fluid communication with the second tube; and
the diaphragm is disposed in the first cavity portion.

15. An adjustable sound distribution system comprising:
an engine operable to produce a pulsation; and
a sound assembly coupled to the engine and disposed upstream from the engine, and wherein the sound assembly is configured to generate sound from the pulsation; the sound assembly comprising:
a housing defining a cavity configured to resonate the sound that exits the sound assembly;
a first member movable to change a frequency of the sound that exits the sound assembly;
wherein:
the housing is defined as a plurality of housings each defining one cavity;
the sound assembly includes a plurality of diaphragms, with one of the diaphragms disposed in the cavity of the respective housings to set different frequencies of the sound that resonates in each cavity; and
the first member is movable to select the desired frequency of the sound that exits the cavity of the respective housings.

16. The system as set forth in claim 15 wherein the first member is defined as a plurality of first members, with the first members each defined as a valve movable between an open position which allows fluid communication to the respective housings and a closed position which prevents fluid communication to the respective housings, with at least one of the valves disposed in the open position to select the desired frequency of the sound that exits the cavity of the respective housings.

17. The system as set forth in claim 15 wherein the housings are grouped together and supported by a bracket.

18. The system as set forth in claim 15 further including a container that surrounds the plurality of housings.

19. The system as set forth in claim 15 wherein the first member is movable linearly.

20. The system as set forth in claim 15 wherein the first member is rotatable.

* * * * *